US006477788B1

(12) United States Patent
Chen

(10) Patent No.: US 6,477,788 B1
(45) Date of Patent: Nov. 12, 2002

(54) SHOE WITH CONCEALED GAITER FASTENERS

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 0 days.

(21) Appl. No.: 09/994,692

(22) Filed: Nov. 28, 2001

(51) Int. Cl.[7] ..... A43B 3/00
(52) U.S. Cl. ..... 36/1.5; 36/2 R
(58) Field of Search ..... 36/1.5, 2 R

(56) References Cited

U.S. PATENT DOCUMENTS

| | | | | | |
|---|---|---|---|---|---|
| 2,230,291 | A | * | 2/1941 | Evans | 36/1.5 |
| 3,312,982 | A | * | 4/1967 | Pitman | 36/1.5 |
| 3,477,147 | A | * | 11/1969 | Bauer | 36/2 R |
| 4,896,437 | A | * | 1/1990 | Johnson | 2/22 |
| 5,170,503 | A | * | 12/1992 | Hightower et al. | 36/2 R |
| 5,491,911 | A | | 2/1996 | Chen | |
| 5,642,573 | A | | 7/1997 | Brown | |

FOREIGN PATENT DOCUMENTS

| | | | |
|---|---|---|---|
| FR | 1053635 | * | 2/1954 |
| IT | 367368 | * | 1/1939 |

* cited by examiner

*Primary Examiner*—Ted Kavanaugh
(74) *Attorney, Agent, or Firm*—Morgan, Lewis & Bockius LLP

(57) ABSTRACT

A shoe includes an upper with a gaiter which has a top end, a bottom end, and two opposite lateral sides interconnecting the top and bottom ends. The gaiter further includes, adjacent to the lateral sides thereof, fasteners to engage one another so as to place the gaiter in a closed position. A zipper has a first zipper strap attached to an inner surface of the gaiter between the lateral sides and between the top and bottom ends of the gaiter and spaced from the bottom end of the gaiter. A second zipper strap to complement with the first zipper strap is attached to the upper adjacent to the top end of the upper. The zipper is therefore concealed within the gaiter and is prevented from contacting external debris, mud, sand or the like.

3 Claims, 4 Drawing Sheets

SHOE WITH CONCEALED GAITER FASTENERS

BACKGROUND OF THE INVENTION

1. Field of the Invention

The invention relates to a shoe, more particularly to a shoe which has a detachable gaiter and a concealed type fastening system to fasten the gaiter to an upper of the shoe.

2. Description of the Related Art

It is known in the art to provide a shoe with a gaiter which can wrap around the ankle and leg of a user for keeping debris, mud, water or the like from entering the shoe and from staining portions of the clothes of the user above the shoe. U.S. Pat. No. 5,491,911 discloses a detachable gaiter with a fastening system which includes buttons and button holes respectively provided in the gaiter and the upper so as to fasten the gaiter to the upper. A fastening belt is provided additionally so as to keep the gaiter around the ankle and the leg of the wearer. The fastening system as such is not suitable to keep water or mud from entering the shoe due to the presence of the button holes. In addition, the belt which is more or less rigid may cause the user to feel uncomfortable.

A shoe suggested in U.S. Pat. No. 5,642,573 incorporates a gaiter with hook-and-loop fasteners (Velcro fasteners) to interengage two opposite overlapping ends of the gaiter after the gaiter is disposed around the ankle and leg of the wearer. The shoe further includes a pouch disposed at the collar of the upper thereof to receive the gaiter and a zipper to close the pouch. In this system, since the zipper is exposed from the shoe and the pouch, the zipper can get dirty with mud and/or sand, or can even be abraded by debris such as sticks and rocks when the shoe is used in hiking or hunting.

SUMMARY OF THE INVENTION

An object of this invention is to provide a shoe with a gaiter which is waterproof and which has a concealed type fastening system to fasten the gaiter to an upper of the shoe, thereby eliminating the aforesaid problems encountered with the prior art.

Accordingly, a shoe of the present invention comprises: an upper having a top open end, and a bottom end; a sole connected to the bottom end; and a gaiter including a top end, a bottom end, and two opposite lateral sides interconnecting the top and bottom ends. The gaiter further includes, adjacent to the lateral sides, fasteners to engage one another so as to place the gaiter in a closed position. A zipper has complementary first and second zipper straps, wherein the first zipper strap is attached to an inner surface of the gaiter between the lateral sides and between the top and bottom ends of the gaiter and is spaced from the bottom end of the gaiter. The second zipper strap is attached to the upper adjacent to the top end of the upper.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
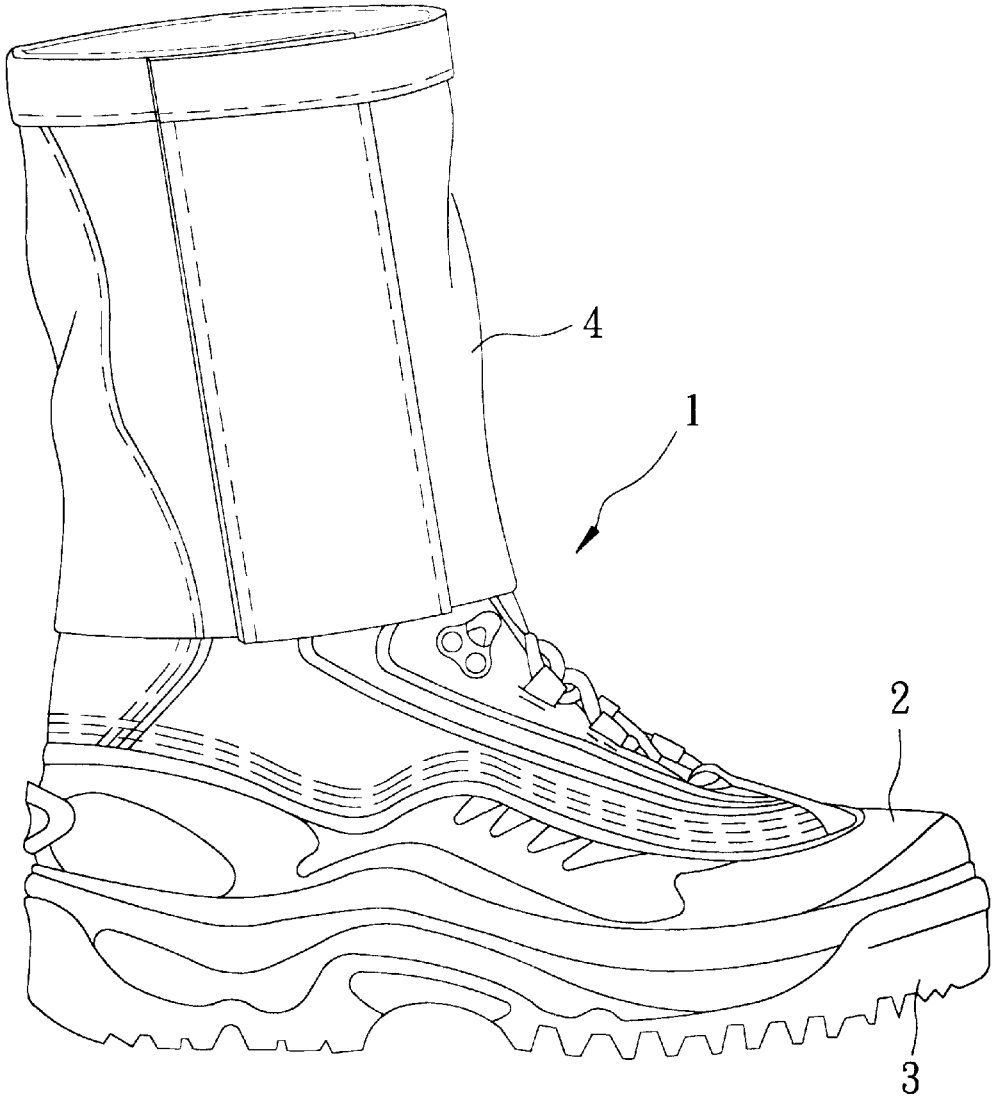
FIG. 1 is a perspective view of a preferred embodiment of a shoe according to the present invention, with a gaiter being in a closed state.
Figure 2:
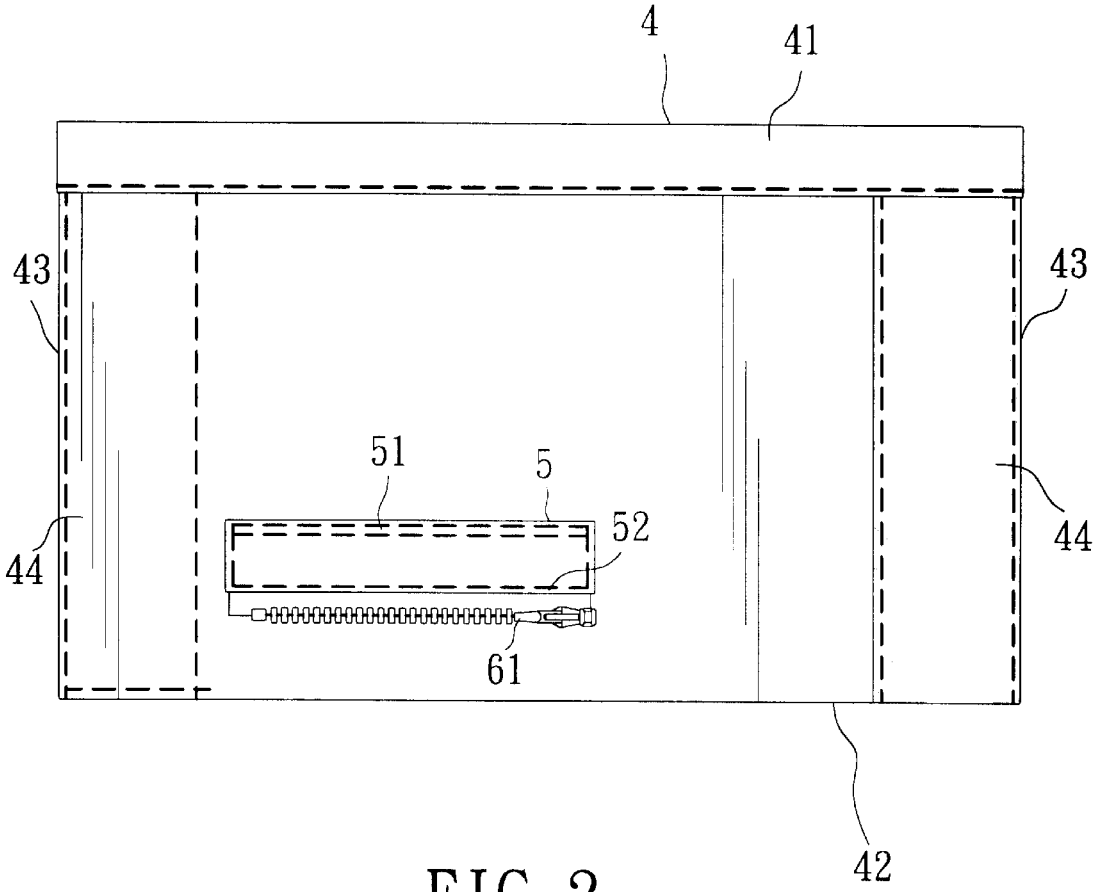
FIG. 2 is a plan view of the gaiter of the shoe of FIG. 1.
Figure 3:
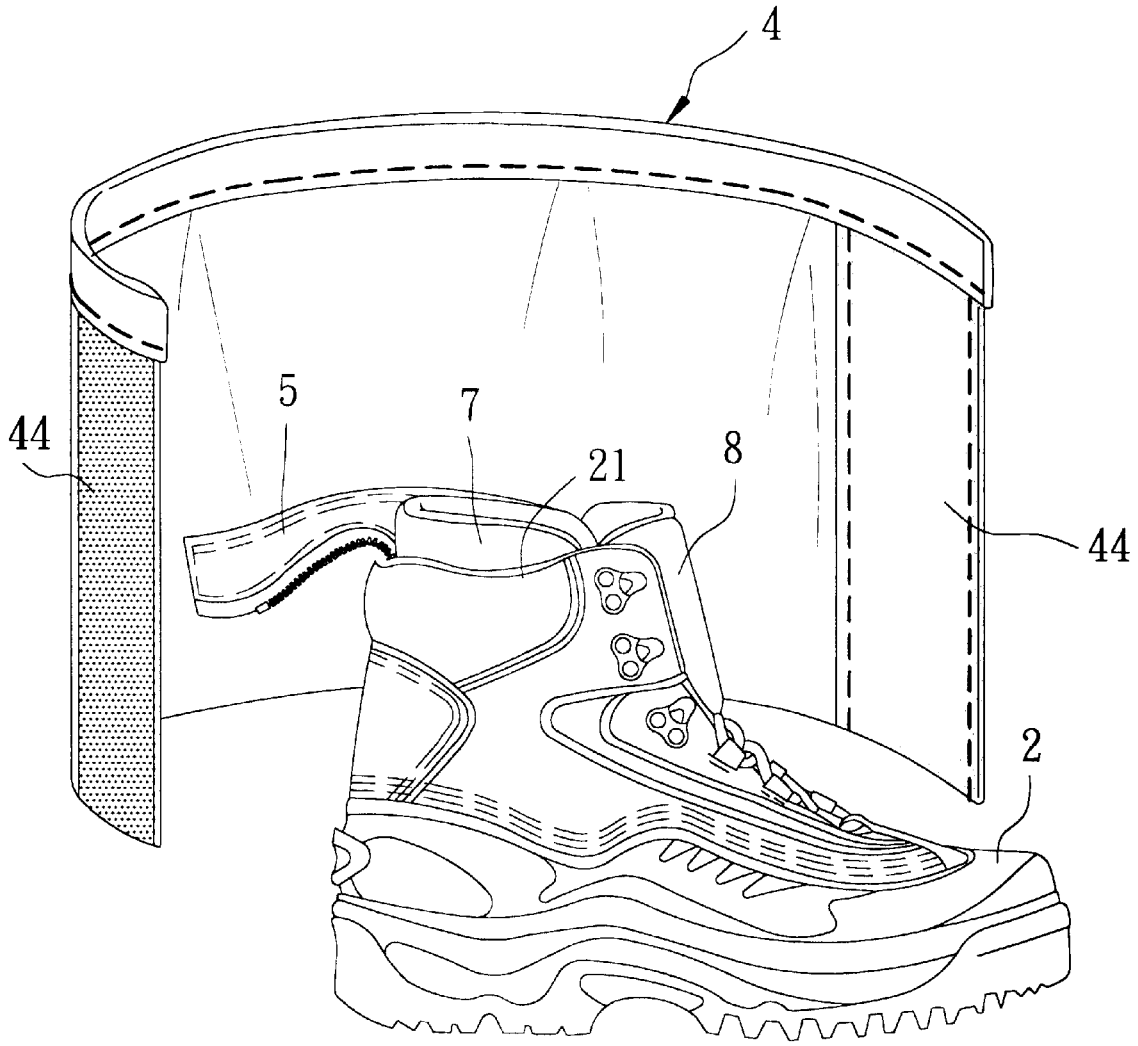
FIG. 3 is a perspective view of the shoe of FIG. 1 but with the gaiter in an open state.
Figure 4:
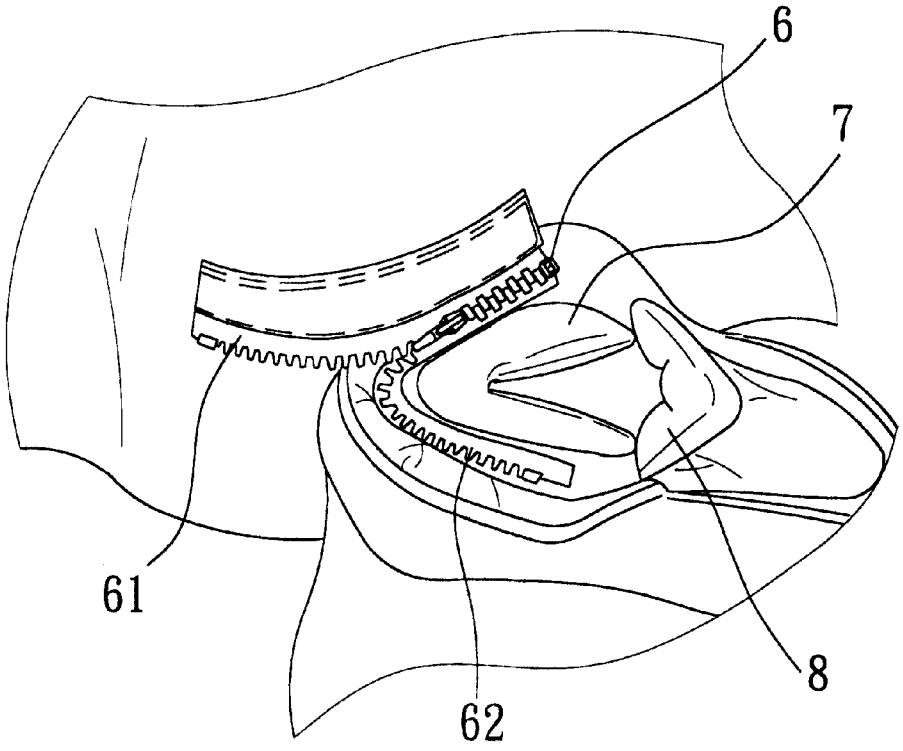
FIG. 4. is a fragmentary top plan view of the shoe of FIG. 1.

Referring to FIGS. 1, 2, 3 and 4, a shoe 1 embodying the present invention is shown to include an upper 2 having a sole 3 and a gaiter 4. The gaiter 4 is made of a material, such as PVC or PU, or a fabric, and includes a top end 41, a bottom end 42, and two opposite lateral sides 43 interconnecting the top and bottom ends 41, 42. The gaiter 4 further includes opposite hook-and-loop fastener portions 44, i.e. Velcro fasteners, disposed adjacent to the lateral sides 43. When the gaiter 4 is placed around the ankle and leg of a wearer with the lateral sides 43 in an overlapping position, the hook-and-loop fastener portions 44 are interengaged, thus placing the gaiter 4 in a closed state as shown in FIG. 1.

The gaiter 4 further includes a flap member 5 which has an upper end 51 attached to an inner surface of the gaiter 4 between the top and bottom ends 41, 42 of the gaiter 4, and an opposite lower suspended end 52 which extends above the bottom end 42 of the gaiter 4. A zipper 6 has a first zipper strap 61 sewn to the lower suspended end 52, and is spaced from the bottom end 42 of the gaiter 4. Both the flap member 5 and the zipper 6 are disposed between the opposite lateral sides 43 of the gaiter 4.

The zipper 6 further has a complementary second zipper strap 62 to mate with the first zipper strap 61. The second zipper strap 62 is attached to an inner surface of the upper 2 adjacent to the top end 21 of the upper 2 without extending to the tongue 8 of the upper 2. Preferably, the upper 2 is additionally provided with a collar member 7 which extends along and inwardly of the top end 21 of the upper 2. The second zipper strap 62 is attached to the inner surface of the upper 2 and extends between the collar member 7 and the top end 21 of the upper 2. The collar member 7 serves to keep the second zipper strap 62 from contacting the ankle of the wearer.

As mentioned above, the zipper 6 is attached to the inner surface of the gaiter 4 and is spaced from the bottom end 42 of the gaiter 4 so that the zipper 6 is completely concealed within the gaiter 4. Due to the concealed zipper 6, the problems encountered with the conventional exposed zipper as described hereinbefore can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A shoe comprising:

an upper having a top open end, and a bottom end;

a sole connected to said bottom end;

a gaiter including a top end, a bottom end, and two opposite lateral sides interconnecting said top and bottom ends, said gaiter further including, adjacent to said lateral sides, fasteners to engage one another so as to place said gaiter in a closed position;

a zipper having complementary first and second zipper straps, said first zipper strap being attached to an inner surface of said gaiter between said lateral sides and between said top and bottom ends of said gaiter, said first zipper strap being spaced from said bottom end of said gaiter, said second zipper strap being attached to said upper adjacent to said top end of said upper; and said upper further includes a collar member which extends along and inwardly of said top end of said upper, said second zipper strap being attached to an inner side of said upper and extending between said collar member and said top end of said upper.

2. The shoe as claimed in claim 1, further comprising a flap member having an upper end attached to an inner surface of said gaiter between said top and bottom ends of said gaiter, and an opposite lower suspended end extending above said bottom end of said gaiter, said first zipper strap being sewn to said lower suspended end.

3. The shoe as claimed in claim 1, wherein said fasteners include hook-and-loop fasteners.

* * * * *